US007579783B2

(12) United States Patent
Millard et al.

(10) Patent No.: US 7,579,783 B2
(45) Date of Patent: Aug. 25, 2009

(54) MICROPROCESSOR-CONTROLLED INSERTABLE FLASHLIGHT ADAPTER DEVICE

(76) Inventors: Michael P. Millard, 265 S. Federal Hwy., #324, Deerfield Beach, FL (US) 33441; Gary A. Minker, 7225 Carmine Lake Dr., Lake Worth, FL (US) 33487

( * ) Notice: Subject to any disclaimer, the term of this patent is extended or adjusted under 35 U.S.C. 154(b) by 281 days.

(21) Appl. No.: 11/695,551

(22) Filed: Apr. 2, 2007

(65) Prior Publication Data

US 2008/0238342 A1 Oct. 2, 2008

(51) Int. Cl.
*H05B 37/00* (2006.01)

(52) U.S. Cl. ..... 315/200 A; 315/224; 315/241 P

(58) Field of Classification Search ..... 315/200 A, 315/241 P, 224, 240, 241 R, 242, 243
See application file for complete search history.

(56) References Cited

U.S. PATENT DOCUMENTS 5,498,934 A * 3/1996 Nilssen ..... 315/224

* cited by examiner

*Primary Examiner*—David Hung Vu

(74) *Attorney, Agent, or Firm*—Davis M. Chin, Jr.; Davis Chin

(57) ABSTRACT

An insertable flashlight adapter device for use in an ordinary flashlight having a lamp includes a disc-like shaped housing unit. Electronic circuitry is disposed within the housing unit for selectively operating the flashlight in at least three different modes. The electronic circuitry has a voltage comparator for determining which one of the at least three different modes the flashlight is being operated. The electronic circuitry also has logic and control means for selectively interrupting current to the flashlight lamp so as to cause the at least three different modes of operation. The logic and control means includes a first timer for monitoring a first time interval between mode changes in the voltage comparator and a second timer for monitoring a second time interval between a power-ON and power-OFF state of the flashlight lamp. As a result, the adapter device has eliminated the need of modifications to make an ordinary flashlight operate selectively in the different modes of operation and to maintain the lifespan of the original ON-OFF switch.

18 Claims, 4 Drawing Sheets

MICROPROCESSOR-CONTROLLED INSERTABLE FLASHLIGHT ADAPTER DEVICE

BACKGROUND OF THE INVENTION

1. Field of the Invention

This invention relates generally to portable light sources, such as flashlights and the like. More particularly, the invention relates to a microprocessor-controlled insertable flashlight adapter device adapted for use with an ordinary flashlight for selectively operating in at least three different modes.

2. Description of the Prior Art

Ordinary battery-operated flashlights heretofore are generally limited to standard beam-ON and beam-OFF operation under a user's manual activation of a switch. In order to obtain an attention-alerting flashing operation or coded message, such as Morse Coded messages, the user is required to manually activate the flashlight's ON-OFF switch. This action can significantly shorten the life of the ON-OFF switch. In addition, many users may not know Morse Code, or be able to maintain the character and inter-character timing associated with such codes.

While it is possible for a user to manually operate a flashlight's ON-OFF switch to emulate flashing or Morse Code operation, all other known solutions require the replacement of the entire flashlight for a more capable model in order to obtain the multiple modes of operation realized by the present invention.

The prior art has provided various solutions, but all of which require substantial modification of the flashlight body or internal circuitry. As such, the prior art solutions are not universally applicable to the large number of flashlights already manufactured and in use throughout the world.

In view of these problems, attempts have been made heretofore in the prior art to continuously develop new implementations so as to create techniques in which the user can operate the ordinary flashlight in multiple modes of operation without having to manually activate repeatedly, and thus shortening the life of, the ON-OFF switch. Although these improvements may have performed so as to maintain, or even increase, the life of the ON-OFF switch, these improvements inconveniently required adding an additional switch and bulb to the flashlight in order to achieve this goal.

A prior art search directed to the subject matter of this application in the U.S. Patent and Trademark Office revealed the following Letters Patent:

| |
|---|
| 4,703,402 |
| 4,835,665 |
| 5,091,611 |
| 5,321,591 |
| 5,667,293 |
| 5,671,999 |
| 5,909,952 |

Further, the prior art search also revealed Patent Application Publication Nos. 2004/0246713 dated Dec. 9, 2004 to Kwak and 2005/0128739 dated Jun. 16, 2005 to Sansolo.

U.S. Pat. Nos. 5,909,952 and 5,671,999 both to Guthrie et al. disclosed a flashing identification light adaptor system for a flashlight. In particular, the flashing light adaptor system includes an adaptor housing which is intended to replace the end cap, which includes male threads adapted to mate with the female threads in the barrel of the flashlight. The flashing light adapter housing includes a dedicated switch, a strobe light and a flasher circuit.

Further, there is disclosed in U.S. Pat. No. 5,667,293 to Own a flashlight with illumination and alerting effect comprising of a handle body, a lamp hood and a control circuit. The control circuit is retained within the large step of the handle body and comprises mainly a printed circuit board holder, a printed circuit board, an elastic push button and a connecting element. The printed circuit board is provided with two elastic switches at positions corresponding to the passing holes respectively, and incorporated with a cable connector at its front end, a conductive wire at the rear end. The conductive wire is soldered to a conductive copper plate wall of the sleeve and connected to the positive pole of a battery. The positive pole of the battery connects to the conductive copper plate of the printed circuit board, and its negative pole connects to the handle body made of metallic material. The bulb in the alerting lamp set can be controlled by the printed circuit board at the control circuit to provide either a twinkling effect or a constant lighting effect. The dots on the elastic push button are used to control the elastic switches of the printed circuit board, one for selection of On, Twinkling, or Off modes and the other selection of illumination lamp set or alerting lamp set.

Further, the patent to Cimock et al., U.S. Pat. No. 5,321,591 discloses a flashlight which includes a strobe module. Enclosed in the strobe housing is an integrated circuit board, which incorporates a strobing circuit. The strobing circuit consists of a master transistor and a slave transistor, which form a Darlington circuit, a drain resistor, a resistor, an electrolytic capacitor and a flashlight bulb. Thus, when the strobing circuit is implemented the flashing bulb begins to strobe according to the time constant of the capacitor and the values of resistors in the circuit until the batteries are disconnected from the circuit.

The remaining patents, listed above but not specifically discussed, are deemed to be only of general interest and show the state of the art in battery-operated flashlights.

Therefore, it should come as no surprise that designers in the industry have been developing and constructing a more efficient way to adapt an ordinary flashlight into a flashing flashlight heretofore in the prior art so as to maintain the lifespan of the original ON-OFF switch. In spite of these efforts in the prior art, it would be still desirable to provide a microprocessor-controlled insertable flashlight adapter device for use in a flashlight so as to limit the amount of modifications, to the body or circuitry of the original flashlight, required to make the flashlight selectively operate in at least three different modes and to maintain the lifespan of the original ON-OFF switch.

None of the prior art discussed above discloses a microprocessor-controlled insertable flashlight adapter device like that of the present invention which eliminates the burdensome modifications needed to make an original flashlight selectively operate in at least three different modes.

SUMMARY OF THE INVENTION

Accordingly, it is a general object of the present invention to provide a microprocessor-controlled insertable flashlight adapter device for an ordinary flashlight which facilitates an easy means for a flashlight operator to create a steady beam, a flashing light or "SOS"-style message without fatiguing the operator, or causing adverse wear to the flashlight's existing ON-OFF switch.

It is an object of the present invention to provide a microprocessor-controlled insertable flashlight adapter device for an ordinary flashlight which interrupts the current to the bulb of an ordinary flashlight such that flashing of the beam may occur at regular intervals without the need for the flashlight operator to continuously operate the flashlight switch.

It is another object of the present invention to provide a microprocessor-controlled insertable flashlight adapter device for an ordinary flashlight which interrupts the current to the bulb of an ordinary flashlight such that the flashing of the beam occurs at internationally recognized character coded sequences, such as Morse Code "S-O-S" style messages.

It is still another object of the present invention to provide a microprocessor-controlled insertable flashlight adapter device for an ordinary flashlight which is housed in series with the existing battery or batteries in the body of the ordinary flashlight.

In a preferred embodiment of the present invention, there is provided an insertable flashlight adapter device for use in an ordinary flashlight having a lamp which includes a disc-like shaped housing unit. Electronic circuitry is disposed within the housing unit for selectively operating the flashlight in at least three different modes. The electronic circuitry has a voltage comparator for determining which one of the at least three different modes the flashlight is being operated.

The electronic circuitry also has logic and control means for selectively interrupting current to the flashlight lamp so as to cause the at least three different modes of operation. The logic and control means includes a first timer for monitoring a first time interval between mode changes in the voltage comparator and a second timer for monitoring a second time interval between a power-ON and power-OFF state of the flashlight lamp. As a result, the adapter device has eliminated the need of modifications to make an ordinary flashlight operate selectively in the different modes of operation and to maintain the lifespan of the original ON-OFF switch.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein.

DESCRIPTION OF THE PREFERRED EMBODIMENTS

Figure 1:
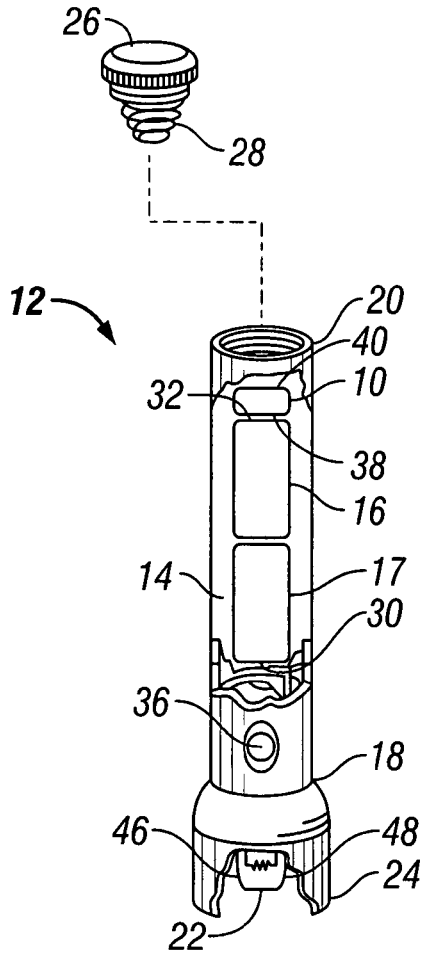
FIG. 1 is an exploded view of an ordinary flashlight, showing the implementation of a microprocessor-controlled insertable flashlight adapter device constructed in accordance with the principles of the present invention.

It is to be distinctly understood at the outset that the present invention shown in the drawings and described in detail in conjunction with the preferred embodiments is not intended to serve as a limitation upon the scope or teachings thereof, but is to be considered merely as an exemplification of the principles of the present invention.

Referring now in detail to the drawings, wherein like reference characters designate like or corresponding parts throughout the several views, there is illustrated in FIGS. 1 through 5 a preferred embodiment, constructed in accordance with the principles of the present invention.

FIG. 1 illustrates a multi-cell tubular flashlight 12, similar to the many flashlights already manufactured and in service throughout the world, in use with the microprocessor-controlled insertable flashlight adapter device 10 of the present invention. The flashlight includes a spring-loaded tubular cell compartment 14 which accommodates a number of cells 16, 17 placed end to end in electrical series. The cells 16, 17 extend substantially from a first end 18 to a second end 20 of the cell compartment 14. When placed within the cell compartment 14, the cells 16, 17 are positioned in such a manner so that a positive terminal 30 of each cell is directed toward the first end 18 of the cell compartment 14 and a negative terminal 32 of each cell is directed toward the second end 20.

A lamp bulb 22 having a negative terminal or contact 46 and a positive terminal or contact 48 is located at the first end 18 within a flashlight head 24. A removable tail cap 26 is located at the second end 20 and contains a spring 28. Once the tail cap 26 is secured to the second end 20 of the cell compartment 14, the spring 28 of the tail cap 26 is engaged with the negative terminal 32 of the cell 16. An ON-OFF switch 36, having a first end 42 and a second end 44, selectively couples the negative terminal 32 of the cells to the negative terminal 46 of the lamp bulb 22.

Up to this point, a conventional flashlight 12 has been described in order to show the adapter device 10 of the present invention in use with the flashlight. Thus, it should be obvious to one skilled in the art that any functional flashlight could also be used with the present invention.

Figure 2:
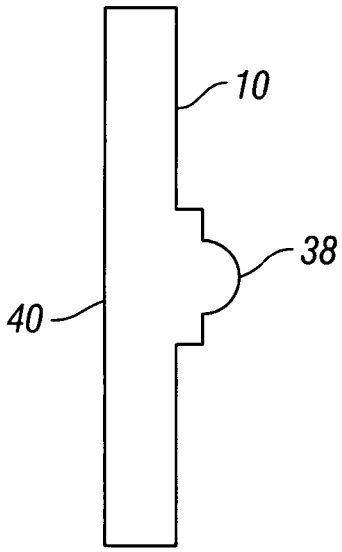
FIG. 2 is a side view of the microprocessor-controlled insertable flashlight adapter device.

Continuing along, the adapter device 10 is inserted within the cell compartment 14, and in between the negative terminal 32 of the cell 16 and the spring 28 of the tail cap 26. As shown in FIG. 2, the adapter device 10 includes a positive terminal 38 and a negative terminal 40. Once positioned within the flashlight compartment 14, the positive terminal 38 of the adapter device 10 is in contact with the negative terminal 32 of the cell 16 and the negative terminal 40 of the adapter device is coupled with the first end 42 of the ON-OFF switch 36 via the spring 28 (FIG. 1).

However, it should be noted that the adapter device 10 may be placed at any position within the cell compartment 14 as long as the adapter device 10 is in series appropriately with the cells 16, 17. The adapter device 10 is designed to approximate the cross-sectional diameter of trade size primary cells (batteries), particularly C-size or D-size cells. The adapter device 10 includes a housing unit which is preferably formed of a generally flat disc-like configuration. The adapter device 10 is approximately a quarter inch thick and houses electronic logic and control circuitry 411 (shown in FIGS. 4 and 5), which selectively activates the different modes of operation when inserted into the standard flashlight 12.

Figure 3:
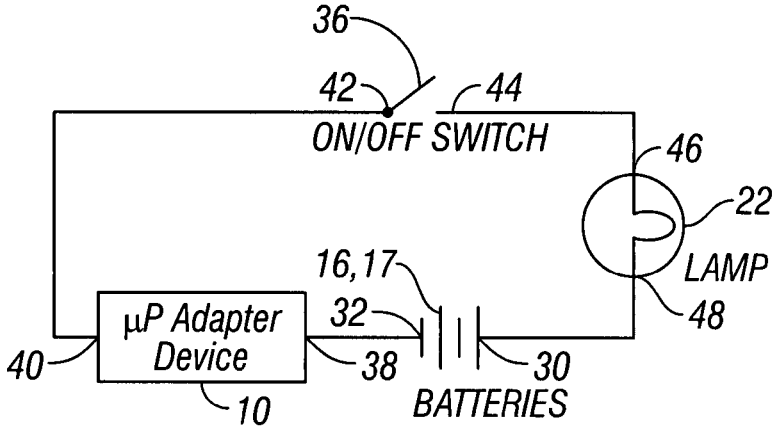
FIG. 3 is a simplified electrical schematic diagram of the microprocessor-controlled insertable flashlight adapter device of FIG. 2 in use with an ordinary flashlight.

Referring now to FIG. 3, a simplified electrical schematic diagram of the microprocessor-controlled insertable flashlight adapter device 10 adapted for use within an ordinary flashlight is illustrated. In particular, there is shown the ON-OFF switch 36, the lamp bulb 22, the multiple cells 16, 17 and the adapter device 10 of the present invention all connected in series. The first end 42 of ON-OFF switch 36 is connected to the negative terminal 40 of the adapter device 10. The positive terminal 38 of the adapter device 10 is connected to the negative terminal 32 of the cell 16. Progressing through the circuit, it can be seen that the positive terminal 30 of the cell 17 is connected to the positive contact 48 of the lamp bulb 22. Finally, the negative contact 46 of lamp bulb 22 is connected to the second end 44 of the ON-OFF switch 36.

Figure 4:
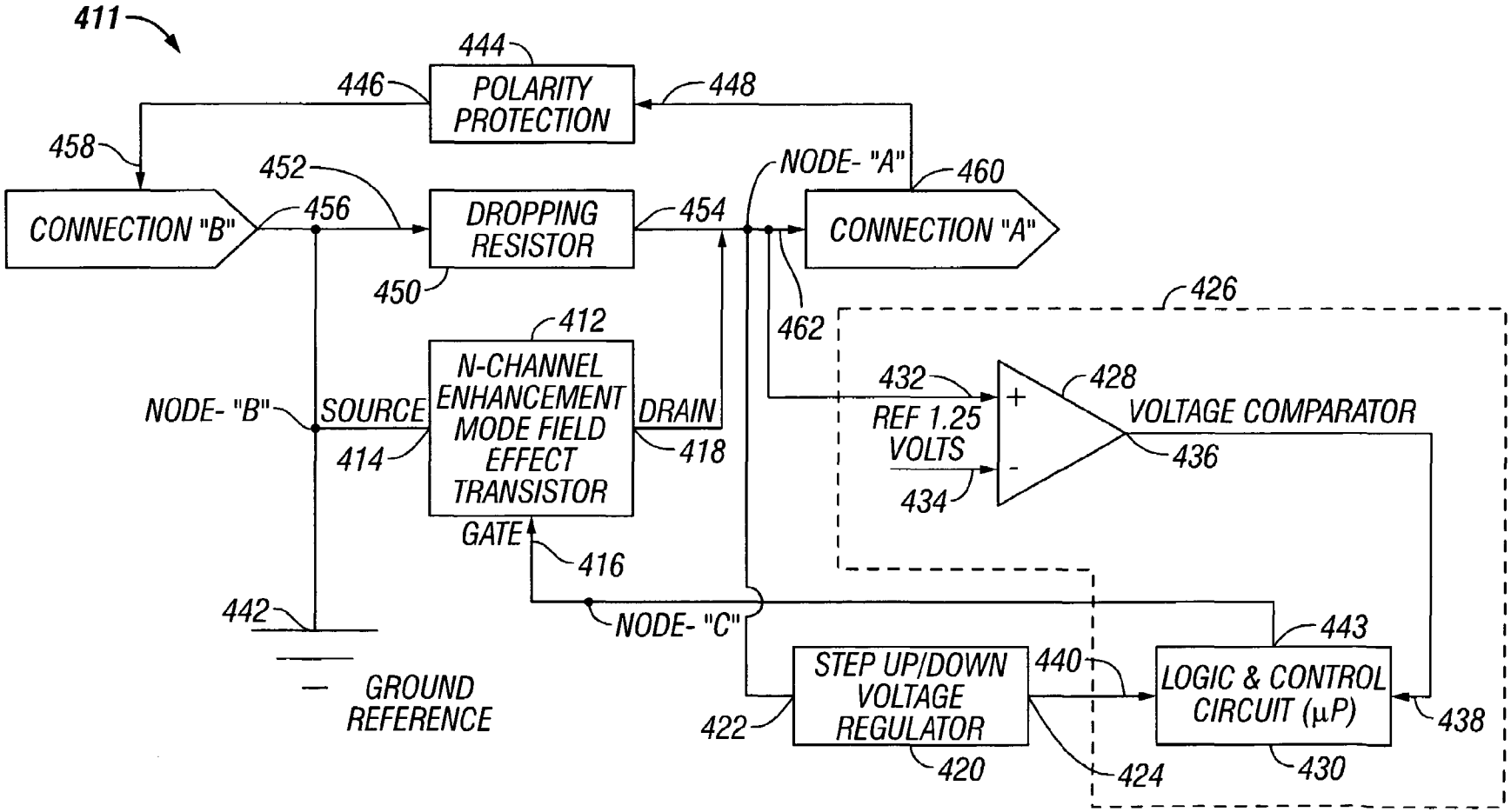
FIG. 4 is a general block diagram of the electronic circuitry housed within the microprocessor-controlled insertable flashlight adapter device.
Figure 5:
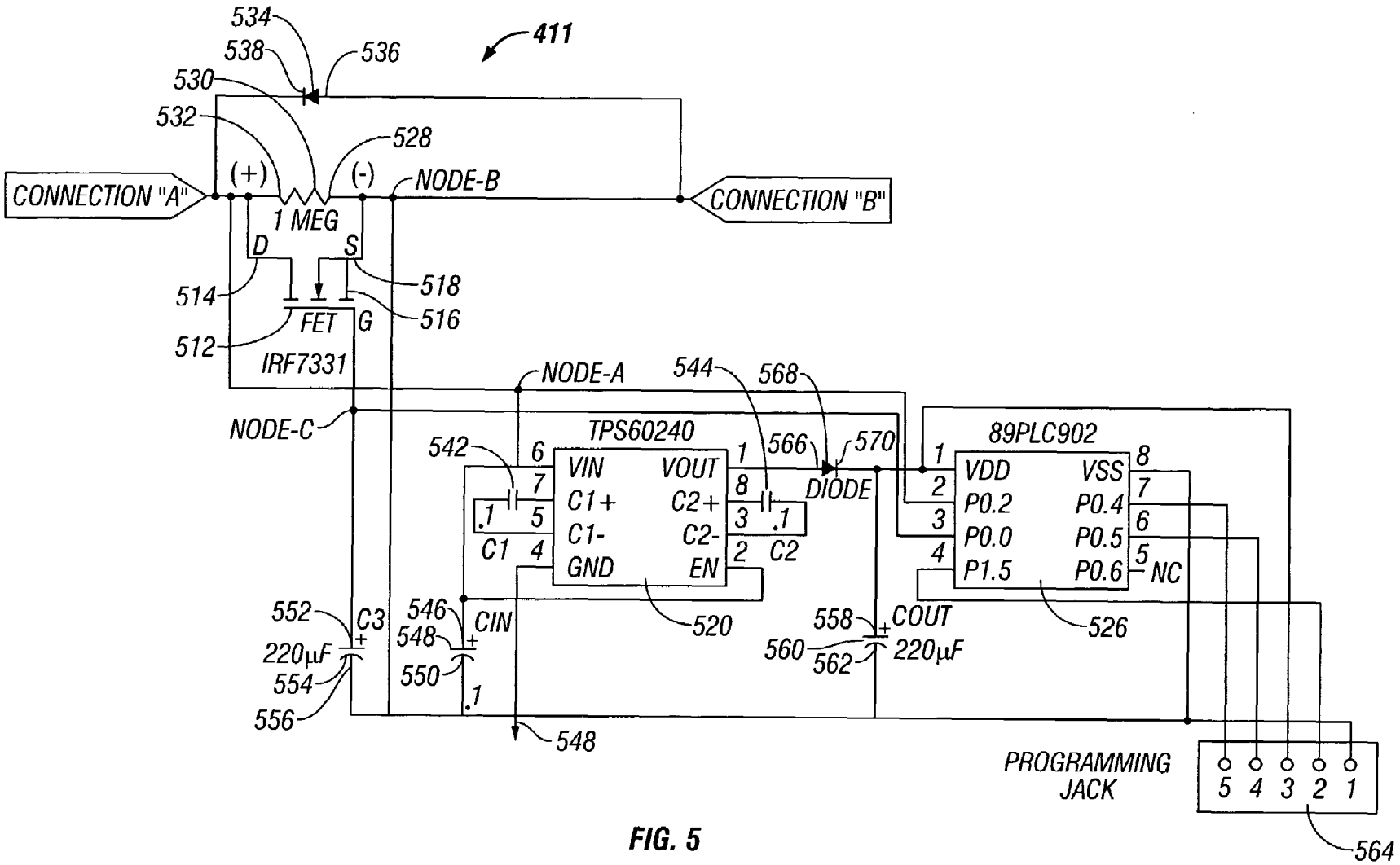
FIG. 5 is a detailed electrical schematic circuit diagram of the electronic circuitry of FIG. 4.

FIG. 4 is a general block diagram of the electronic circuitry 411 housed within the insertable flashing adapter device 10 of FIG. 2. The electronic circuitry 411 includes an N-Channel Enhancement Mode Field Effect Transistor (FET) 412 having a drain 418, a gate 416 and a source 414; a step up/down voltage regulator 420 having an input 422 and an output 424; and a processing unit 426 consisting of a voltage comparator 428 and a logic and control circuit (microprocessor) 430. The step up/down voltage regulator 420 may be incorporated into one integrated circuit chip, such as one similar to the commercially available Texas Instruments TPS60240 chip (as shown in FIG. 5). Along the same lines, the processing unit 426 may also be incorporated into one integrated circuit chip, such as one similar to the commercially available Phillips Electronics P89LPC902 8-bit microcontroller (as shown in FIG. 5).

The voltage comparator 428 is formed of an operational amplifier having a non-inverting input 432, an inverting input 434 and an output 436. While the non-inverting input 432 of the voltage comparator is connected to a node A, the inverting input 434 is connected to a reference voltage 444 having a value of approximately +1.25 volts. The microprocessor 430 has a first input 438, which is connected to the output 436 of the voltage comparator 428; a second input 440, which is connected to the output 424 of the voltage regulator 420; and an output 443, which is connected to the gate 416 of the FET 412. The input 422 of the voltage regulator 420 is connected to the node A.

The electronic circuitry 411 of FIG. 4 also includes a polarity protection component 444 having a first end 446 and a second end 448, and a dropping resistor 450 having a first end 452 and a second end 454. The source 414 of the FET 412 is coupled to a ground reference 442 via a node B. The drain 418 of the FET is connected to node A. The first end 452 of the dropping resistor 450 is coupled to a first end 456 of a connection terminal B via node B. The second end 454 of the resistor 450 is connected to node A. A second end 458 of terminal B is connected to the first end 446 of polarity protection component 444. The second end 448 of polarity protection component 444 is connected to a first end 460 of a connection terminal A. A second end 462 of terminal A is connected to node A.

FIG. 5 is a detailed electrical schematic circuit diagram of the electronic circuitry 411 of FIG. 4. The electronic circuitry 411 includes an N-Channel Enhancement Mode Field Effect Transistor (FET) 512 having a drain 514, a gate 516 and a source 518; a step up/down voltage regulator 520; and a processing unit 526 (including the voltage comparator 428 and the microprocessor 443 of FIG. 4). The source 518 of the FET 512 is connected to a first end 528 of a resistor (R1) 530 and to a ground potential 540 via a node B. The drain 514 of the FET 512 is connected to a second end 532 of resistor 530. The gate 516 of FET 512 is connected to a node C. The node C is connected to pin 3 of the processing unit 526 and is also connected to a first end 552 of a holding capacitor (C3) 554. A second end 556 of the holding capacitor 554 is connected to the ground potential 540.

The electronic circuitry 411 also includes a first diode 534 (polarity protection component 444 of FIG. 4) having an anode 536 connected to the node B and a cathode 538 connected to node A. A terminal connection B is coupled to the ground potential 540 via the node B. A terminal connection A is coupled to pin 6 of the voltage regulator 520 via the node A and is also coupled to pin 2 of the processing unit 526.

A flying capacitor (C1) 542 is placed across pins 7 and 5 of the voltage regulator 520. Another flying capacitor (C2) 544 is placed across pins 8 and 3 of the voltage regulator 520. Pin 4 of the voltage regulator 520 is connected to the ground potential 540. Pin 1 of the voltage regulator 520 is connected to an anode 566 of a second diode 568. A cathode 570 of the second diode 568 is connected to pin 1 of the processing unit 526 and to a first end 558 of a supply capacitor (Cout) 560. A second end 562 of capacitor 560 is connected to the ground potential 540. Pins 2 and 6 of the voltage regulator are coupled to a first end 546 of an input capacitor (Cin) 548. A second end 550 of the input capacitor 548 is connected to the ground potential 540.

A programming jack 564 is used to program the microprocessor of the processing unit 526. Pin 1 of the programming jack 564 is coupled to pin 8 of the processing unit 526 and the ground potential 540. Pin 2 of the programming jack 564 is connected to pin 4 of the processing unit 526. Pin 3 of the programming jack 564 is connected to pin 1 of the processing unit 526. Pin 4 of the programming jack 564 is connected to pin 6 of the processing unit 526. Pin 5 of the programming jack 564 is connected to pin 7 of the processing unit 526.

With reference to FIGS. 4 and 5, the operation of the electronic circuitry 411 will now be described in detail. At the outset, it will be noted that the dropping resistor 450 (530) is connected in-series with the flashlight lamp bulb 22 via the terminal connections A and B. The dropping resistor 530 functions as a current limiter so as to restrict the flow of current which effectively prevents the flashlight lamp bulb 22 from being illuminated. When the user initially activates the ON-OFF switch 36 of the flashlight, an insufficient amount of current will flow so to cause the flashlight lamp bulb 22 to remain extinguished due to the dropping resistor 530.

However, the dropping resistor 530 will establish a voltage that is stored in the input capacitor 548 to supply power to the step-up/down voltage regulator 420 (520), which, in turn, provides power to the logic and control circuit 430 of the processing circuit 426. This resistor voltage is also provided to the voltage comparator 428 of the processing unit 426. The voltage comparator 428 is used to compare the voltage on resistor 530 with the reference voltage of +1.25 volts generated from within the logic and control circuit 430.

The FET 412 (512) having a gate controlled by the logic and control circuit 430 is connected in parallel with the dropping resistor 530. When the FET 512 is turned "ON" under the control of the circuit 430, the small on-resistance of the FET will be connected in parallel with the dropping resistor 530 so as to effectively create a short circuit. This allows sufficient current to flow in order to cause the flashlight lamp bulb 22 to be lighted. When the FET 512 is rendered conductive, the lamp bulb 22 will shine at a slightly reduced intensity than when the adapter device 10 of the present invention is not used due to the small on-resistance of the FET 512.

The step-up/down voltage regulator 520 is preferably a switched capacitor buck-boost converter design utilizing two internal voltage charge pumps. The flying capacitors 542 and 544 are required for the proper operation of the internal voltage charge pumps. The polarity protection diode 534 is connected in a reversed bias manner across the terminal connection A and B in order to protect the electronic circuitry 411 when it is accidentally inserted improperly into the flashlight battery cell compartment 14. If either of the batteries 16, 17 or the adapter device 10 is installed with the incorrect polarity, the polarity protection diode will allow current to bypass the electronic circuitry 411 so as to protect it from being damaged. However, in this situation, the brightness of the lamp bulb 22 will be noticeably reduced due to the voltage drop across the polarity protection diode 534 being forward biased.

The supply capacitor 560 serves to hold a charge for maintaining proper operation of the logic and control circuit 430 during the time periods when the FET 512 is rendered conductive. This supply capacitor 560 is required since the shorting of the dropping resistor 530 will cause the input voltage on the supply capacitor 548 to collapse, thereby rendering inoperative the step-up/down voltage regulator 420 (520) and eventually, the processing circuit 426 (526).

The current being drawn from the supply capacitor 560 is minimized by causing the logic and control circuit 430 to enter "Idle" or "Shutdown" modes until the next activity of the FET 512 is required. When the step-up/down voltage regulator 520 is rendered inoperative, the second diode 568 is used to block the discharge path, thereby preventing discharge of the supply capacitor 560 through the step-up/down voltage regulator 520.

The logic and control circuit 430 is used to interrupt the current to the lamp bulb 22 by sequentially activating and deactivating the FET 512 in accordance with the relevant stored time intervals. The circuit also monitors the status of the flashlight's ON-OFF switch 36, and estimates the run time of current mode of operation of the flashlight via two internal timers. In particular, the logic and control circuit 430 monitors the status of the flashlight's ON-OFF switch 36 by sampling the input voltage on pin 6 of the step-up/down voltage regulator 520.

The logic and control circuit 430 determines whether a mode change request has been issued by indirectly monitoring the position of the flashlight's ON-OFF switch 36. However, this is performed only after the circuit 430 has caused the FET 512 to be rendered non-conductive. When the presence of a significant amount of voltage across the parallel-connected FET 512 and dropping resistor 530 is detected on the non-inverting input 432 of the comparator 428, the output 436 thereof will be at a high or logic "1" state which indicates that the flashlight switch 36 is in the "CLOSED" condition. Similarly, when no significant voltage is detected across the parallel-connected FET 512 and dropping resistor 530 on the non-inverting input 432, the output 436 of the comparator 428 will be at low or logic "0" state which indicates that the flashlight switch 36 is in the "OPEN" condition.

A short timing subroutine stored within the logic and control circuit 430 functions to debounce all switch activations, and if needed as determined by the current operating mode, it will discharge the holding capacitor 554 so as to allow for accurate input conditions to the voltage comparator 520. Finally, the status of the flashlight's ON-OFF switch 36 as mentioned above is compared with the reference voltage by the voltage comparator 428 in order to determine which of three different modes of operation, i.e. a steady beam mode, a flashing beam mode, or a Morse Coded "SOS" style beam mode, is being requested.

Figure 6:
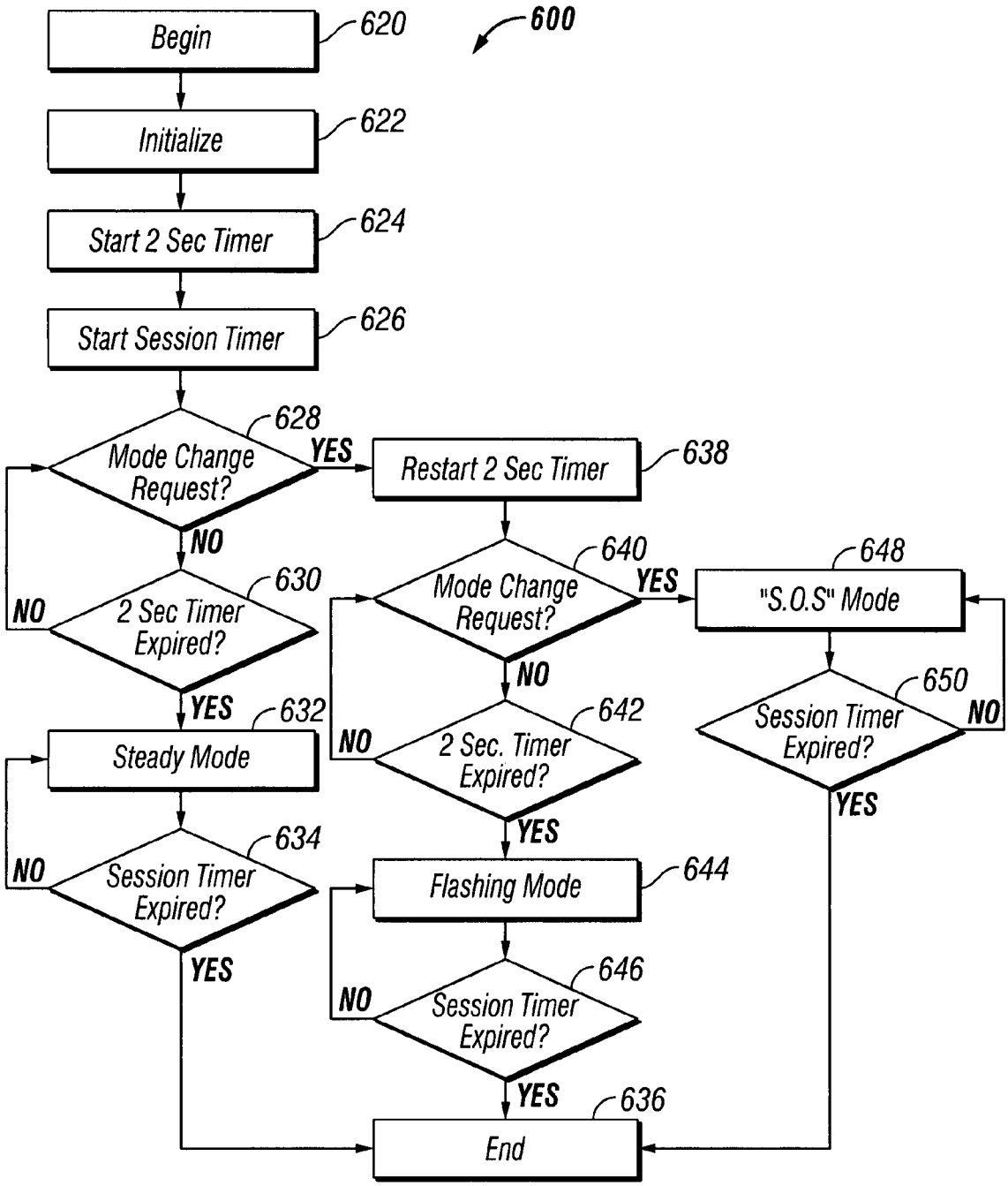
FIG. 6 is a flow chart diagram, illustrating the different modes of operation when the microprocessor-controlled insertable flashlight adapter device is in use with an ordinary flashlight.

Referring to FIG. 6, a flow chart diagram illustrates the different modes (steady, flashing, and "S.O.S.") of operation when the insertable flashing adapter device is inserted for use within an ordinary flashlight. The flow chart starts with BEGIN block 620. BEGIN block 620 includes the step of the flashlight user engaging the ON-OFF switch to the ON position. This first switching of the ON-OFF switch to ON will not illuminate the flashlight bulb because current will not flow due to the action of the dropping resistor 530 (FIG. 5). BEGIN block 620 then proceeds to INITIALIZE block 622. INITIALIZE block 622 includes the process of the step up/down voltage regulator 520 establishing a charge onto the supply capacitor 560 (FIG. 5) sufficient to operate the logic circuit 430 (FIG. 4), which will commence execution of the programmed instructions.

INITIALIZE block 622 continues onto START 2 SEC TIMER block 624 where the first clock, a two-second timer, is initialized. START 2 SEC TIMER block 624 continues onto START SESSION TIMER block 626 where the second clock, a session timer having a predetermined duration, such as 10 minutes, is initialized.

Once the clocks are initialized, the process then proceeds to MODE CHANGE REQUEST decision block 628. Here, while the two-second timer is running, the logic circuit 430 will check the voltage comparator 428 (FIG. 4) output for a state change. A state change is implemented by the user toggling the ON-OFF switch prior to the expiration of the two-second timer. If no state change is detected, the MODE CHANGE REQUEST block 628 proceeds to a 2 SEC TIMER EXPIRED? decision block 630. If the two-second timer has not expired, then the process loops back to the MODE CHANGE REQUEST decision block 628. If the two-second timer has expired, then the 2 SEC TIMER EXPIRED? block 630 advances to the STEADY MODE block 632.

In the STEADY MODE block 632, the holding capacitor 554 (FIG. 5) will charge so that the logic circuit 430 will enter an idle state while not affecting the ON status of the FET 512. In other words, the flashlight will operate in a steady mode and maintain a constant beam of light.

Moving along, the STEADY MODE block 632 proceeds to the SESSION TIMER EXPIRED? decision block 634. If the session timer does not expire, then the step loops back to the STEADY MODE block 632 and the flashlight continues to operate in the steady mode. However, if the session time does expire, the process step advances to the END block 636. Once the session timer expires, the logic circuit 430 will disable the FET 512. The disabled FET 512 effectively deactivates the flashlight regardless of the position of the ON-OFF switch.

Going back to MODE CHANGE REQUEST decision block 628, if a state change is detected, because the user has toggled the ON-OFF switch, then the block proceeds to RESTART 2 SEC TIMER block 638. Once the two-second timer is restarted, the process then advances to MODE CHANGE REQUEST decision block 640. Here, while the two-second timer is running, the logic circuit 430 will check the voltage comparator 428 (FIG. 4) output for a state change. If no state change is detected, the MODE CHANGE REQUEST block 640 proceeds to a 2 SEC TIMER EXPIRED? decision block 642. If the two-second timer has not expired, then the process loops back to the MODE CHANGE REQUEST decision block 640. If the two-second timer has expired, then the 2 SEC TIMER EXPIRED? block 642 advances to the FLASHING MODE block 644.

In the FLASHING MODE block 644, the logic circuit 430 interrupts the flashlight bulb current by sequentially activating and deactivating the FET 512 according to the relevant time interval stored in the logic circuit 430. In other words, the flashlight will operate in a flashing mode and will flash at a constant interval.

Moving along, the FLASHING MODE block 644 proceeds to the SESSION TIMER EXPIRED? decision block 646. If the session timer does not expire, then the step loops back to the FLASHING MODE block 644 and the flashlight continues to operate in the flashing mode. However, if the session time does expire, the step advances to the END block 636. Once the session timer expires, the logic circuit 430 will disable the FET 512. The disabled FET 512 effectively deactivates the flashlight regardless of the position of the ON-OFF switch.

Going back to MODE CHANGE REQUEST decision block 640, if a state change is detected, because the user has toggled the ON-OFF switch, then the block proceeds to S.O.S. MODE block 648. In the S.O.S. MODE block 648, the logic circuit 430 interrupts the flashlight bulb current by sequentially activating and deactivating the FET 512 according to the relevant time interval stored in the logic circuit 430. In other words, the flashlight will operate in an S.O.S. mode and will flash at an interval that corresponds to the Morse code for S.O.S.

Finally, the S.O.S. MODE block 648 proceeds to the SESSION TIMER EXPIRED? decision block 650. If the session timer does not expire, then the step loops back to the S.O.S. MODE block 648 and the flashlight continues to operate in the S.O.S. mode. However, if the session time does expire, the process step advances to the END block 636. Once the session timer expires, or if the user turns off the flashlight, the logic circuit 430 will commence operation as if no mode had been previously selected.

It should be understood that upon expiration of any two-second timer, the logic circuit 430 will no longer search for state changes, and instead, will operate the FET 512 according to the mode selected until expiration of the session timer or until the user turns off the flashlight.

From the foregoing detailed description, it can thus be seen that the present invention provides a more efficient and effective way to adapt an ordinary flashlight for selectively operating in three different modes but yet maintains the lifespan of the original ON-OFF switch. As a result, the adapter device of the present invention eliminates the burdensome modifications needed to make an original flashlight operate selectively in a steady beam, a flashing light, or "S.O.S." mode without adversely affecting the lifespan of the original ON-OFF switch.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

The invention claimed is:

1. An insertable flashlight adapter device for use in an ordinary flashlight having a lamp, comprising:

a disc-like shaped housing unit;

electronic circuit means disposed within said housing unit for selectively operating the flashlight in at least three different modes;

said electronic circuit means having voltage comparator means for determining which one of the at least three different modes the flashlight is being operated;

said electronic circuit means having logic and control means for selectively interrupting current to the flashlight lamp so as to cause the at least three different modes of operation; and said logic and control means having first timing means for monitoring a first time interval between mode changes in said voltage comparator means and second timing means for monitoring a second time interval between a power-ON and power-OFF state of said flashlight lamp.

2. An insertable flashlight adapter device as claimed in claim 1, wherein said disc-like shaped housing unit is of a size approximating the cross-sectional diameter of a standard C-sized battery.

3. An insertable flashlight adapter device as claimed in claim 1, wherein said disc-like shaped housing unit is of a size approximating the cross-sectional diameter of a standard D-sized battery.

4. An insertable flashlight adapter device as claimed in claim 1, wherein said at least three different modes include a steady beam mode, a flashing mode and an "S.O.S." Morse coded message mode.

5. An insertable flashlight adapter device as claimed in claim 2, wherein said housing unit is arranged in series with the standard battery.

6. An insertable flashlight adapter device as claimed in claim 1, wherein said electronic circuit means further includes a field effect transistor which is activated and deactivated so as to interrupt the current to the flashlight lamp.

7. An insertable flashlight adapter device as claimed in claim 1, wherein said electronic circuit means further includes polarity protection means for protecting against improper insertion of said flashlight adapter device into said flashlight.

8. An insertable flashlight adapter device as claimed in claim 7, wherein said polarity protection means includes a diode.

9. An insertable flashing adapter as claimed in claim 1, wherein said electronic circuit means further includes current limiting means for restricting flow of current to effect incandescence of the flashlight lamp.

10. In an ordinary flashlight, comprising, in combination:

a lamp bulb;

ON-OFF switching means for powering said flashlight;

said flashlight having compartment means for receiving a power supply;

a disc-like shaped housing unit;

electronic circuit means disposed within said housing unit for selectively operating the flashlight in at least three different modes;

said electronic circuit means having polarity protection means for protecting against improper insertion of an adapter device into said flashlight; and said housing unit being in electrical series with said power supply, said lamp bulb and said ON-OFF switching means for powering said flashlight lamp.

11. In an ordinary flashlight as claimed in claim 10, wherein said disc-like shaped housing unit is of a size approximating the cross-sectional diameter of a standard C-sized battery.

12. In an ordinary flashlight as claimed in claim 10, wherein said disc-like shaped housing unit is of a size approximating the cross-sectional diameter of a standard D-sized battery.

13. In an ordinary flashlight as claimed in claim 10, wherein said at least three different modes include a steady beam mode, a flashing mode and an "S.O.S." Morse coded message mode.

14. In an ordinary flashlight as claimed in claim 11, wherein said housing unit is arranged in series with the standard battery.

15. In an ordinary flashlight as claimed in claim 10, wherein said electronic circuit means includes a field effect transistor which is activated and deactivated so as to interrupt current to the flashlight lamp.

16. In an ordinary flashlight as claimed in claim 10, wherein said polarity protection means includes a diode.

17. In an ordinary flashlight as claimed in claim 10, wherein said electronic circuit means further includes current limiting means for restricting flow of current to effect incandescence of the flashlight lamp.

18. A method for using an adapter device to selectively operate a flashlight in at least three different modes of operation, said method comprising the steps of:

providing electronic circuitry in the adapter device to selectively operate the flashlight in the at least three different modes of operation;

providing the electronic circuitry to include polarity protection to protect against improper insertion of the adapter device into the flashlight;

activating firstly an ON-OFF switch to cause a steady beam mode of operation;

activating secondly the ON-OFF switch to cause a flashing mode of operation; and activating thirdly the ON-OFF switch to cause an "S.O.S." Morse coded message mode of operation.

* * * * *